United States Patent [19]

Gray

[11] 4,357,591

[45] Nov. 2, 1982

[54] VARIABLE RESISTOR

[75] Inventor: Richard Gray, Tyne & Wear, England

[73] Assignee: Allen-Bradley Company, Milwaukee, Wis.

[21] Appl. No.: 266,027

[22] Filed: May 21, 1981

[30] Foreign Application Priority Data

May 28, 1980 [GB] United Kingdom ..... 8017413

[51] Int. Cl.[3] ..... H01C 10/32

[52] U.S. Cl. ..... 338/162; 338/174; 338/DIG. 1

[58] Field of Search ..... 338/162, 174, 180, 181, 338/188, DIG. 1

[56] References Cited

U.S. PATENT DOCUMENTS

| | | | |
|---|---|---|---|
| 3,124,777 | 3/1964 | Mellor | 338/174 |
| 3,195,092 | 7/1965 | Tumbusch | 338/148 |
| 3,201,737 | 8/1965 | Mathison | 338/174 |
| 3,242,452 | 3/1966 | Grunwald et al. | 338/174 |
| 3,351,881 | 11/1967 | Merz | 338/123 |
| 3,363,212 | 1/1968 | Joy | 338/174 |
| 3,488,618 | 1/1970 | Yungblut et al. | 338/164 |
| 3,497,856 | 3/1970 | Scheel | 338/162 |
| 3,522,573 | 8/1970 | Michik | 338/171 |
| 3,569,896 | 3/1971 | Kirkendall | 338/162 |
| 3,576,512 | 4/1971 | Michik | 338/174 |
| 3,596,223 | 7/1971 | Stuckey | 338/174 |
| 3,701,070 | 10/1972 | Baldwin et al. | 338/162 |
| 3,757,267 | 9/1973 | Gerstmeier | 338/174 |
| 3,982,220 | 9/1976 | Rozema et al. | 338/174 |
| 4,004,264 | 1/1977 | Hogue et al. | 338/174 |
| 4,114,132 | 9/1978 | DeRouen et al. | 338/174 |
| 4,114,133 | 9/1978 | Stephens | 338/174 |

*Primary Examiner*—C. L. Albritton
*Attorney, Agent, or Firm*—Arnold J. Ericsen

[57] ABSTRACT

A trimmer potentiometer or like variable resistor, which is of the kind having a worm 21 driving an elastomeric worm wheel 10 carrying a wiper contact to slide on an arcuate resistance element, has the gear teeth formed on circumferentially-spaced rim sections 23, 24, 25 projecting cantileverwise from an axially thick unbroken rim 10*b* of a radial flange on the main body 10*c* of the wheel, some sections 23 having only a few gear teeth and being separated by sections 24, 25 having larger numbers of gear teeth. The extent of rotation of the wheel 10 is limited to less than 360° and the sections 23 with few teeth are arranged to be in mesh with the worm at the limits of wheel rotation so as to give a de-clutching effect by inward deflection of these sections on over rotation of the worm.

5 Claims, 4 Drawing Figures

VARIABLE RESISTOR

BACKGROUND OF THE INVENTION

This invention relates to variable resistors of the kind (herein referred to as the kind specified) comprising an arcuate resistor element applied on a substrate forming part of a housing for a rotor carrying a wiper contact which contacts the resistor element and, as the rotor rotates, varies a tapping point on the resistor element, the rotor being formed peripherally with gear teeth meshing with a worm by which the rotor is rotated. Such resistors may be used as trimmer potentiometers and are usually of small dimensions.

Desirably a variable resistor of the kind specified is provided with abutments limiting the extent of rotation of the rotor to less than 360° and also with a "clutching" arrangement which allows slipping between the rotor gear teeth and the worm if the latter is rotated in a manner tending to rotate beyond the limits of the prescribed extent of rotation, thereby to avoid damage to the resistor by forcible operation of the worm gear. In one form of such clutching arrangement (see U.S. Pat. Nos. 3,416,119 and 3,446,085) the rotor is of an elastomeric material and has a minor part of its gear-toothed periphery separated from the central boss of the rotor by circumferentially-extending through slotting of the rotor so that the minor part is more radially deflectable than the remainder of the periphery; the minor part may have one end divided off from the remainder of the periphery or may be divided into two at its middle.

Such clutching arrangements, while allowing satisfactory clutching, have disadvantages in manufacture and use. Thus in moulding the rotor one of the faces of the minor peripheral part must be a "shut-off" face in the mould so that a flash may be produced which would adversely affect its operation. Also in order to allow correct clutching, the minor part has an extent comprising several gear teeth with the result that poor engagement between the gear teeth and the worm is possible away from the limiting positions of travel of the rotor where the clutching action is not required, leading to inaccurate or poor setting of the device.

SUMMARY OF THE INVENTION

According to the present invention, in a variable resistor of the kind specified having the rotor limited to less than 360° of rotation and having a "clutching" arrangement which allows slipping between the rotor gear teeth and the worm when the rotor reaches a limit of its rotation, the wiper-carrying rotor is of an elastomeric material, has a radial web extending to the periphery of the rotor to provide an unbroken thickness of the periphery, and has extending from the unbroken thickness an axially-directed divided skirt providing circumferentially-separated, axially-directed cantilever flanges bearing the gear teeth, there being such flanges having respectively a few gear teeth and several gear teeth.

By the provision of such a web and flanges, not only may the rotor be moulded without formation of flashes at the breaks between the flanges, which breaks may conveniently be axial slots of width equal to that of a trough between a pair of teeth, the slots extending to the unbroken thickness of the periphery, but also deflection of the skirt by the worm is comparatively strongly resisted by the flanges having several gear teeth so that, by arranging that clutching occurs at a flange having a few gear teeth, accurate settability can be achieved between the limiting positions of rotor travel.

In one particular construction, there are a plurality of flanges having few gear teeth, e.g. three such flanges arranged with a 90° spacing and these flanges alternate circumferentially with flanges having several gear teeth.

DESCRIPTION OF THE PREFERRED EMBODIMENT

Figure 2:
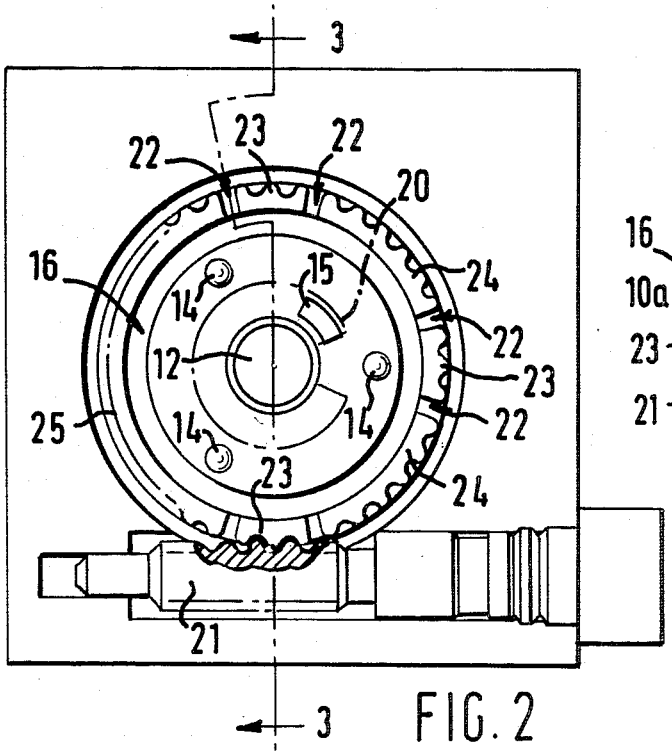
FIG. 2 is a plan view partly in section of the rotor in a potentiometer.

One construction of variable resistor of this invention, suitable for use as a trimmer potentiometer, will now be described by way of example.

The rotor (FIG. 1) 10 ia a moulding of an elastomer, e.g. a resilient plastics material, and has a central bore 11 to fit rotationally on a stub axle 12 in the casing 13 (FIGS. 2 and 3) of the potentiometer, a series of compression pips 14, a stop 15 and an annular groove 16 separating the main body 10*c* of the rotor from an axially-directed peripheral skirt 10*a*, the groove 16 extending part way only through the rotor thickness (FIGS. 3 and 3*a*) so that the skirt 10*a* extends axially and cantileverwise from the undivided thickness 10*b* of a radial flange extending outwards from the main body 10*c*.

The rotor carries a wiper 17 to travel over a part-annular resistor 18 which is carried by a substrate 19 (FIG. 3) by which the casing 13 is closed. The stop 15 projects into a groove 20 in the bottom of casing 13 (FIGS. 2 and 3) and rotation of the rotor 10 is restricted by the stop 15 coming to the end of the part-annular groove 20.

Rotation of the wiper-carrying rotor 10 is effected by a worm 21 which is rotatably mounted in the casing 13 and meshes with worm gear teeth formed in that portion of the rotor periphery which bounds the groove 16.

Figure 3A:
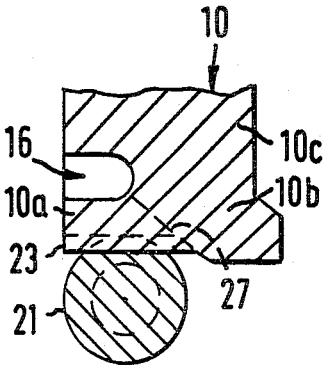
FIG. 3*a* is a part of FIG. 3 drawn to a larger scale.
Figure 3:
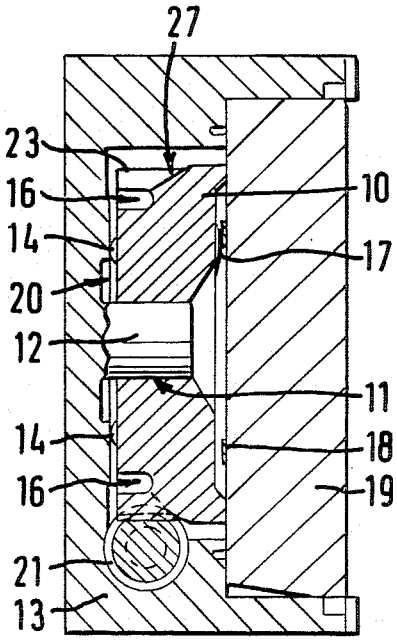
FIG. 3 is a section on the line 3—3 of FIG. 2.
Figure 1:
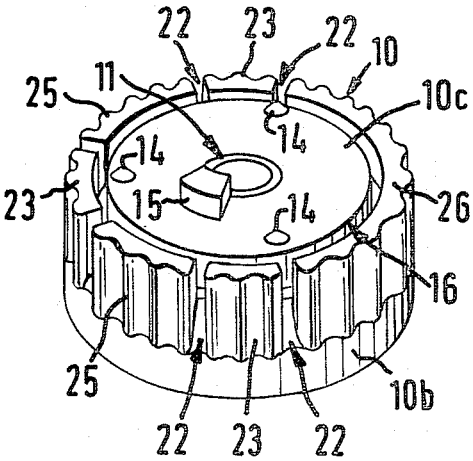
FIG. 1 is an isometric view of a form of wiper-carrying rotor.

As best seen in FIGS. 1 and 2, the toothed portion of the rotor skirt 10*a* is divided by axial slots 22 into a number of sections 23, 24 and 25 whereof the sections 23 are 90° apart, and have a small number of gear teeth, three as shown, and alternate with the remaining sections. Sections 24 have a larger number of teeth, six as shown in FIG. 2, and the section 26 extends around almost half the periphery and has the largest number of teeth. The tooth arrangement allows the rotor to be used with potentiometers with different ranges of angular movement.

It will be noted (FIGS. 3 and 3*a*) that the toothed sections 23, 24, 25 forming the skirt 10*a* extend axially and cantileverwise from a solid outer part 10*b* of the rotor periphery axially beyond the bottom of the groove 16 and that the roots of the tooth (see at 27 in FIGS. 3 and 3*a*) merge gradually into the unbroken thickness 10*b* at the periphery of the radial flange. It will be also noted from FIGS. 1 and 2 that the slots 22 which separate the sections 23, 24, 25 correspond in width substantially to the width of the trough between a pair of gear teeth.

In assembly of a potentiometer, the sections 23 having least teeth are set to mesh with the worm 21 when the stop 15 is against the ends of grooves 20 so that these sections 23, which offer least resistance to radial deflection, can allow "clutching" if over-winding of the worm 21 occurs. In other positions of the rotor, the sections 24, 25 offer sufficient resistance to deflection to avoid any clutching tendency.

The compression pips 14 are conical prior to assembly but are somewhat deformed on assembly of the substrate 19 thereby to locate the rotor 10 squarely in the casing.

Apart from the advantageous "clutching" action the rotor has the advantage that it can be moulded without the production of flashing as would be formed if for instance the slots 22 extended fully across the thickness of the rotor periphery.

The embodiments of the invention of which an exclusive property of privilege is claimed are defined as follows:

1. A variable resistor having an arcuate resistor element, a rotor having gear teeth and carrying a wiper contact which contacts the resistor element, and a rotatable worm meshing with the gear teeth of said rotor, having the rotor limited to less than 360° of rotation and having a "clutching" arrangement which allows slipping between the rotor gear teeth and the worm when the rotor reaches a limit of its rotation, wherein the wiper-carrying rotor is of an elastomeric material, has a radial web extending to the periphery of the rotor to provide an unbroken thickness of the periphery, and has extending from the unbroken thickness an axially-directed divided skirt providing circumferentially-separated, axially-directd cantilever flanges bearing the gear teeth, there being such flanges having respectively a few gear teeth and several gear teeth.

2. A variable resistor according to claim 1, wherein the flanges are separated by axial slots of width equal to that of a trough between a pair of the gear teeth, the slots extending to the unbroken thickness of a respective flange.

3. A variable resistor according to claim 1 or claim 2, there being a plurality of the flanges having each a few gear teeth.

4. A variable resistor according to claim 3, the flanges comprising three flanges having a few gear teeth, these flanges being arranged with a 90° spacing and alternating with flanges having several gear teeth.

5. In a variable resistor comprising a housing, an arcuate resistor mounted within the housing, a rotor within the housing, the rotor being of an elastomer and being a worm wheel having peripheral gear teeth, a rotatable worm meshing with the gear teeth to rotate the worm wheel, and a contact wiper carried by the rotor and slidable over the arcuate resistor as the rotor is rotated; said rotor having a solid web forming part of the axial thickness of the rotor at its outer periphery, and a plurality of part-annular sections each formed with a number of said gear teeth and each projecting axially cantileverwise from the solid web at the rotor periphery, said part-annular sections being spaced apart by slots extending axially between the sections part way across the rotor periphery to the solid web, at least a first of said gear teeth bearing sections having a small number of the gear teeth and being radially deflectable and at least a second of said gear teeth bearing sections having a larger number of said gear teeth and resisting radial deflection.

* * * * *